US008511493B2

(12) United States Patent
Bernstein

(10) Patent No.: US 8,511,493 B2
(45) **Date of Patent: *Aug. 20, 2013**

(54) LIQUID CONTAINER AND METHOD OF SERVING A LIQUID

(76) Inventor: David Bernstein, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/492,745

(22) Filed: Jun. 8, 2012

(65) Prior Publication Data

US 2012/0233968 A1 Sep. 20, 2012

Related U.S. Application Data

(63) Continuation-in-part of application No. 13/157,263, filed on Jun. 9, 2011, now Pat. No. 8,196,764.

(60) Provisional application No. 61/353,573, filed on Jun. 10, 2010.

(51) Int. Cl.
*B65D 90/12* (2006.01)

(52) U.S. Cl.
USPC ..... 215/377; 215/40; 215/200; 215/250; 215/303; 215/378; 215/387; 220/23.86; 220/630

(58) Field of Classification Search
USPC ..... 220/23.86, 630; 215/40, 200, 250, 215/303, 377, 378, 387
See application file for complete search history.

(56) References Cited

U.S. PATENT DOCUMENTS

| | | | | |
|---|---|---|---|---|
| 640,860 | A | 1/1900 | Baum | |
| 2,086,404 | A | 7/1937 | Daniels | |
| 3,229,840 | A | 1/1966 | Filleul | |
| 3,343,697 | A | 9/1967 | Roberts et al. | |
| D417,820 | S | 12/1999 | Pelz et al. | |
| 6,164,473 | A | 12/2000 | Waldrip | |
| 7,318,329 | B2 | 1/2008 | Penrith | |
| 8,196,764 | B2 * | 6/2012 | Bernstein | 215/377 |
| 2005/0092760 | A1 | 5/2005 | Westerhold | |
| 2008/0264958 | A1 | 10/2008 | Blake | |
| 2009/0001043 | A1 * | 1/2009 | Benetti | 215/377 |

FOREIGN PATENT DOCUMENTS

| | | | |
|---|---|---|---|
| CN | 86208942 | U | 10/1987 |
| DE | 10122951 | A1 | 1/2003 |
| EP | 0802122 | A1 | 10/1997 |
| KR | 20-0413218 | Y1 | 4/2006 |
| KR | 20-2009-0012791 | U | 12/2009 |
| WO | 9037190 | A1 | 7/1999 |
| WO | 0012404 | A1 | 3/2000 |
| WO | 2006-029441 | A1 | 3/2006 |

OTHER PUBLICATIONS

International Search Report issued on Feb. 23, 2012 for International Application No. PCT/US2011/039850.

* cited by examiner

*Primary Examiner* — Anthony Stashick
*Assistant Examiner* — Elizabeth Volz
(74) *Attorney, Agent, or Firm* — Knobbe, Martens, Olson & Bear, LLP

(57) ABSTRACT

A liquid container can be present and used in at least two different positions. The liquid container may be a wine container, which can be a wine bottle in its first position and also be a wine glass in its second position. A method of serving a liquid includes placing a container in a first position in which the container serves as a bottle and converting the bottle into a glass or goblet without reassembling any part of the container by placing the container in a second position.

19 Claims, 18 Drawing Sheets

LIQUID CONTAINER AND METHOD OF SERVING A LIQUID

RELATED APPLICATIONS

This application is a Continuation in Part of U.S. application Ser. No. 13/157,263, filed Jun. 9, 2011, which claims the benefit of U.S. Provisional Application No. 61/353,573, filed Jun. 10, 2010, all of which are incorporated by reference in their entireties.

BACKGROUND OF THE INVENTION

1. Field of the Invention

The present invention is generally related to a liquid container, which can be present and used in at least two different positions. In one embodiment, the liquid container may be a wine container, which can be a wine bottle in its first position and can also be a wine glass in its second position.

2. Description of the Related Art

A liquid container, for example, a single serving wine container has been designed and used in a form of a small screw-top glass bottle, a plastic bottle, an aluminum bottle, an aluminum can or a tetra pack. The convenience and transportability of single serving wine containers would be achieved with these pre-existing forms of containers, but to consume it, a consumer has to drink the wine out of the bottle or can, or bring along his/her own second container such as a glass or goblet. The present invention solves this problem by having the bottle become its own glass.

BRIEF DESCRIPTION OF THE DRAWINGS

FIGS. 1A and 1B shows the container in its first position whereas FIGS. 1C and 1D shows the container in its second position. FIG. 1E shows a top view of the container.

FIG. 2A shows a vertical-sectional view of the container on which the lid is present. FIG. 2B shows a vertical-sectional view of the container wherein the lid is removed. FIGS. 2C and 2D show exploded views of two illustrative examples of a lid.

FIG. 3A shows a vertical-sectional view of the container on which the lid is present. FIG. 3B shows a vertical-sectional view of the container wherein the lid is removed. FIGS. 3C and 3D show exploded views of two illustrative examples of a lid.

FIG. 4A shows a vertical-sectional view of the container on which the lid is present. FIG. 4B shows a vertical-sectional view of the container wherein the lid is removed. FIGS. 4C and 4D show exploded views of two illustrative examples of a lid.

FIG. 5A shows a vertical-sectional view of the container on which the lid is present. FIG. 5B shows a vertical-sectional view of the container wherein the lid is removed. FIGS. 5C and 5D show exploded views of two illustrative examples of a lid.

FIG. 6A shows a vertical-sectional view of the lid. FIG. 6B shows a surface of the lid facing the exterior of the container. FIGS. 6C and 6D show the vertical-sectional views of the container in its second position and its first position, respectively.

FIGS. 7A, 7B, 7C and 7D show the containers in their first positions whereas FIGS. 7E, 7F, 7G and 7H show the containers in their second positions.

FIG. 9A shows a perspective view of the container and FIG. 9B shows a vertical-sectional view of the container. FIG. 9C shows a top-view of a second closing element 90.

SUMMARY OF INVENTION

Figure 1B:
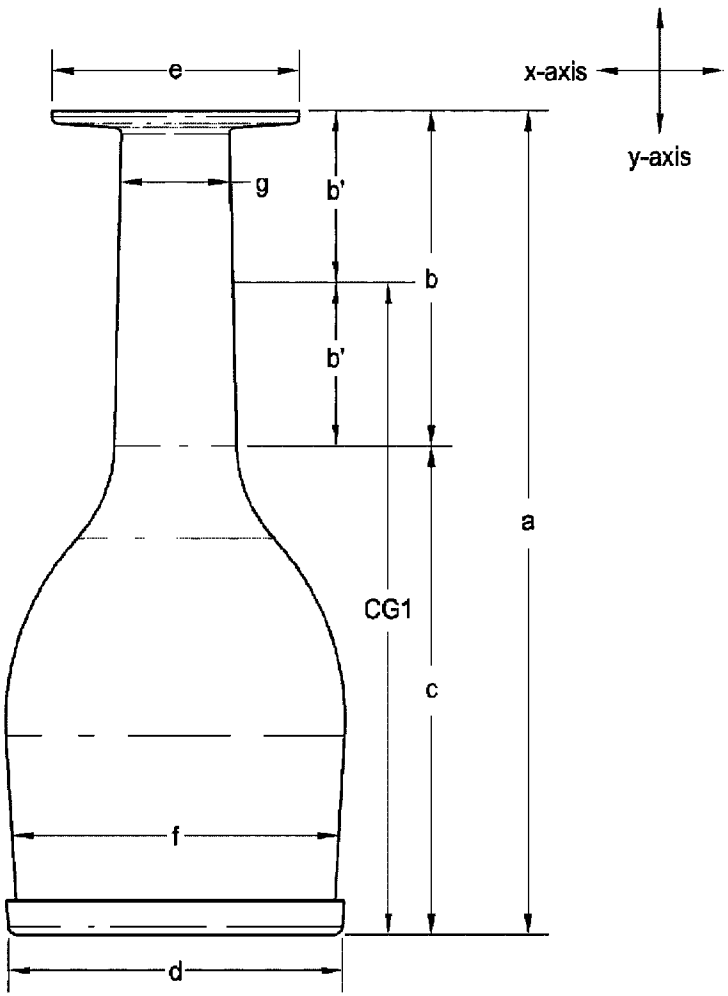
FIGS. 1A-1E shows a non-limiting, illustrative example of a liquid container according to some embodiments of the invention.

One aspect of the invention provides a liquid container, which is in the shape of a bottle with an elongated section at its top in a first position and is convertible to a glass or goblet in a second position with the elongated section at the bottom without reassembling any part of the container. The container may comprise a first end comprising a closed end that is sealed with a first closure, a second end comprising an open end wider than said elongated section, a first body comprising said elongated section, a second body comprising a hollow container, and a second closure, which is adapted to seal said open end of said second end in said first position and to be detached from said open end of said second end in said second position. When the container is in the first position, the container may have a first center of gravity from the first end to the midpoint of the first body when said container is empty and when said container is full of liquid. When the container is in the second position, the container may have a second of center of gravity from the second end to the midpoint of the second body when said container is empty and when said container is full of liquid. When the container is in the second position, the first end forms a base of the glass or goblet, the second end forms an opening of the glass or goblet, the first body forms a stem of the glass or goblet, and the second body forms a body of the glass or goblet. When the container is in the first position, the first end forms a bottle top, the second end and the closure form a bottle base, the first body forms a bottle neck, and the second body forms a bottle body.

According to some embodiments, the elongated section of the container may be hollow such that said first body and said second body comprise a single hollow container. The first closure may fit in the first end and part of the first body, thereby forming an airtight seal. Also, the first closure may be made of one or more selected from the group consisting of natural polymers, synthetic polymers, glass, and metal. More particularly, the first closure may comprise cork.

According to some other embodiments, the liquid may be provided to the container via the first end thorough its open end. The first end may be permanently sealed with the first closure after provision of the liquid to the container.

According to still some other embodiments, the second closure may comprise a secure element, which is configured to prevent leakage of the liquid contained in the container.

The secure element may comprise an O-ring. The second closure may be a re-sealable closure. The second closure may comprise a punt.

According to still some other embodiments, the second closure of the container may comprise a first closing element, and a second closing element, said first closing element being adapted to seal said open end of said second end in said first position and the second element being adapted to cover the first element. The first closing element may be in form of foil seal that provides an airtight seal to said open end of said second end. The second closing element may comprise a pull tab or tear tab. The second closing element may be made of a plastic material.

Another aspect of the invention provides a method of manufacture the container. The method may comprise providing a compartment comprising the first end, the second end, the first body, and the second body, detachably sealing the second end with the second closure, providing liquid inside the container, and permanently sealing the first end with the first closure.

Still another aspect of the invention provides a method of serving a liquid. The method may comprise providing the liquid in a container, which is in the shape of a bottle with an elongated section at its top in a first position and a hollow body below the elongated section in the first position, wherein the container is in the first position in which the container has a first center of gravity from the midpoint of the elongated section to a bottom end of the hollow body, and wherein a detachable closure seals the bottom end of the hollow body in the first position, converting the container into a glass or goblet without reassembling any part of the container by placing the container in a second position in which the container has a second center of gravity from the midpoint of the hollow body to a bottom end of the elongated section, detaching the closure when the container is in the second position, and serving the liquid from the container in the second position without reassembling the closure to the container. In certain embodiments, the liquid may be a wine.

DETAILED DESCRIPTION OF THE PREFERRED EMBODIMENT

The present invention is generally related to a liquid container, which can be present in at least two different positions.

The term "liquid" in this application generally includes all kinds of subject that is in a status of liquid or solution. In some embodiments, the liquid may include, but not limited to, any beverage or drinkable liquid or solution such as liquor, wine, champagne, beer, soft drinks, water, juices, milk, and other kinds. In one embodiment, the liquid may include wine.

The term "container" in this application generally includes any subject that can contain liquid. In some aspects, the container may include, but not limited to, a type of bottle, a type of jar, a type of glass, a type of goblet, a type of cup, and any other kinds. In one embodiment, the container may include a bottle, a glass, and a goblet, especially configured to contain wine.

The term "a bottle (or the like)" in the present application may refer to any types of a container that may function to contain, store, transport, display, and/or process (e.g. fermentation) liquid. Some non-limiting illustrative examples of this term may include a bottle, a jar, a can, and any other kinds.

The term "a glass (or the like)" in the present application may refer to any types of a container that may function to contain and/or store liquid, especially for a serving purpose. In general, a glass (or the like) may contain liquid, which is going to be consumed by a consumer in a relatively short time. Some non-limiting illustrative examples of this term may include a glass, a goblet, a vessel, a cup, and any other kinds.

In one aspect of the present invention, a liquid container may be a bottle (or the like) when displayed and carried in its first position; however, when changed to its second position, the container looks and functions like a glass (or the like). Such container that can be a bottle (or the like) as well as a glass (or the like) can be used as a single serving purpose in at least some embodiments. Therefore, in some illustrative examples, a liquid container may be a single serving wine bottle, which can also function as a glass.

A material used to make a liquid container according to some embodiments of the present invention may comprise a glass, a metal, and any synthetic or natural polymer such as an acrylic, a resin and others. Further, more than one material can be used to make a container such that, in one example, the container may be made with a glass as well as acrylic.

Figure 1A:
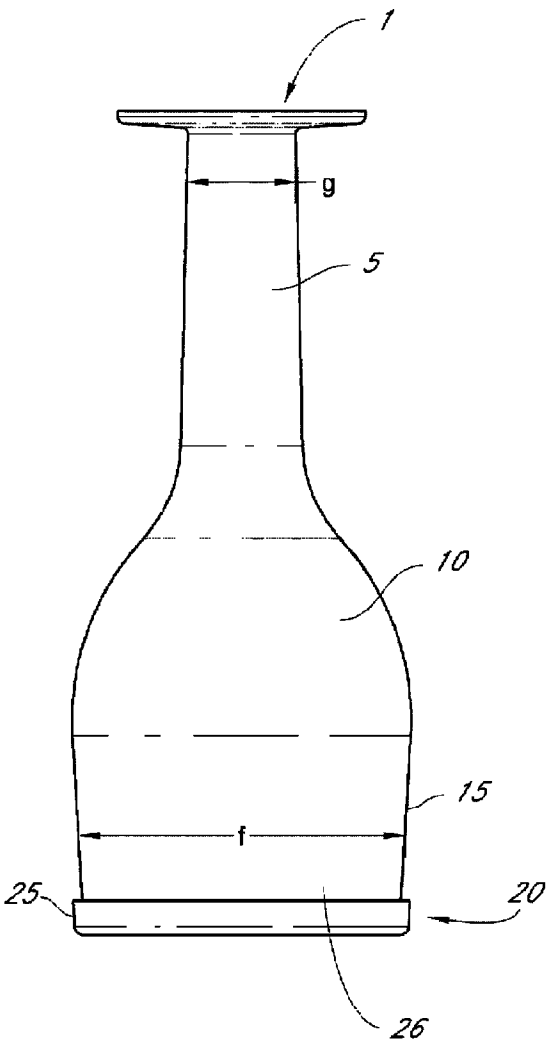
Figure 1D:
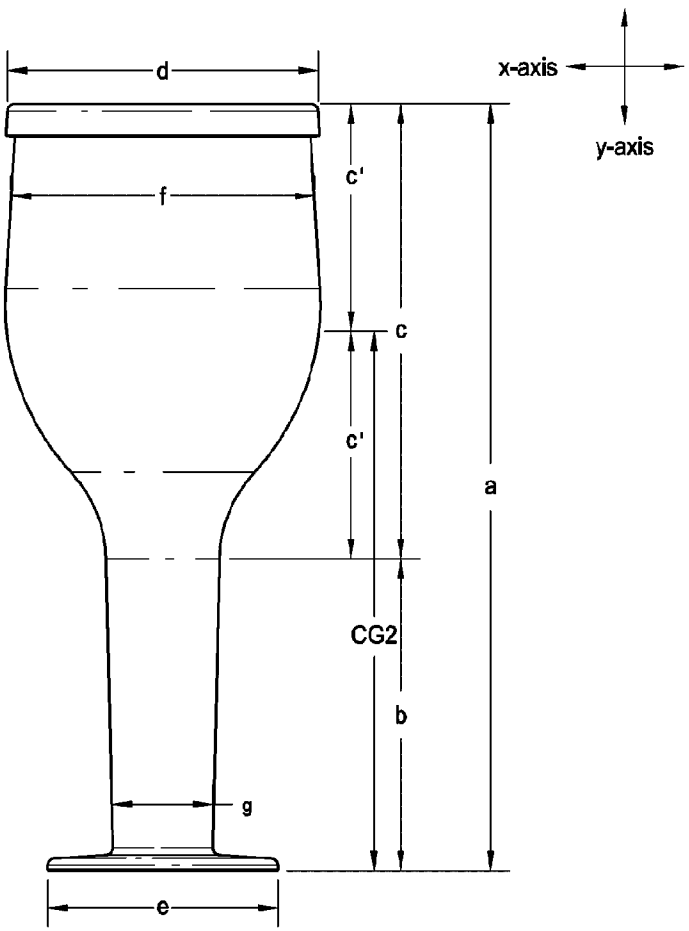
Figure 1C:
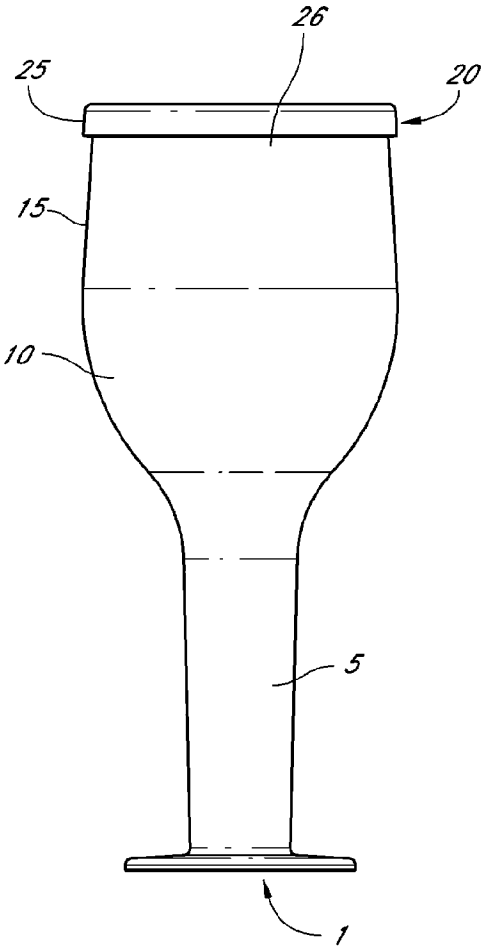

In an example that a liquid container is a wine bottle convertible to a glass, such container can be present or stand in its first position to become a bottle (or the like). See, for example, FIGS. 1A and 1B for instant illustration of a container being its first position. This container, which is present and used as a bottle (or the like), can be converted into a glass (or the like) when the container is into its second position. See, for example, FIGS. 1C and 1D for instant illustration of a container being its second position. When the container is in its second position, the container is present and used as a glass (or the like). In this particular example shown in FIGS. 1A-1D, such conversion can be done by turning a container in its first position (i.e. as shown in FIGS. 1A-1B) upside down to its second position (i.e. as shown in FIGS. 1C-1D). The container may be designed and/or configured to be present or stand alone without any support on its first and second positions. Therefore, a liquid container according to some embodiments of the present invention can be used as a bottle (or the like) as well as a glass (or the like) by instantly converting its positions.

Conversion between a bottle (or the like) and a glass (or the like) according to some embodiments of the present invention can be achieved via a relatively simple and instant way, which comprises turning a container in one position upside down and placing the container in another position. Such conversion would not need additional process such as disassembling and/or reassembling the container. There are some containers known in the art that may be converted from one type (e.g. a bottle) to another type (e.g. drinking vessel). See, for example, U.S. Pat. Nos. 2,086,404, 640,860, 6,164,473, US Patent Application Publication No. US 2005/0092760, and International Application Publication No. WO 00/12404. However, all of such containers in the art require additional process such as disassembling and/or reassembling at least part of the container for the conversion. The containers in the art typically comprise a detachable base. Conversion of such containers into, for example, drinking vessels can be done by removing (or disassembling) the detachable base from the body of the bottle, inverting the body of the bottle, and reattaching (reassembling) the detached base to the top of the bottle. Accordingly, the detached base would serve as a base of the drinking vessels as well as bottles. It is very clear, however, in at least some embodiments of the present invention that such process of disassembling and/or reassembling the container in the art is not necessary to achieve conversion of a bottle (or the like) to a glass (or the like).

For the purpose of instant illustration, liquid containers that are generally a type of wine bottle (which can be convertible to a wine glass) are described as non-limiting examples of some embodiments of the present invention in the following. While only few exemplary applications are described herein for the purpose of illustration, many different modifications and alternations, which should be obvious to a person with ordinary skill in the art, can also be done without affecting the scope of the invention. Therefore, not only the examples disclosed in this application but also such obvious modifications and alterations should also be included in the scope of the invention. For example, a liquid container according to some embodiments of the present invention can be used for other kinds of liquid including any beverage or drinkable liquid or solution such as liquor, wine, champagne, beer, soft drinks, water, juices, milk, and others. Thus, any containers that can be used to contain any kinds of liquid and that can be used as a bottle (or the like) as well as a glass (or the like) are also included in the scope of the invention.

Referring to FIG. 1, a single serving wine bottle is provided as a non-limiting and illustrative example of a liquid container according to some embodiments of the invention. FIGS. 1A and 1B show the liquid container in its first position (i.e. a bottle position) whereas FIGS. 1C and 1D show the liquid container in its second position (i.e. a glass position).

In the foregoing example, the liquid container may comprise a first end (1), a second end (20), a first body (5) comprising an elongated section, a second body (10), and a lid (25), each of which may serve dual-purpose depending on the positions of the container. For example, when the container is in the bottle position, the first end (1), the first body (5), and the second body (10) would look and/or function as a bottle top, a bottle neck, and a bottle body, respectively. In addition, the second end (20) may look and/or function as a base/bottom of the container that is in the first position (i.e. the bottle position; See FIGS. 1A and 1B). However, when the container is turned upside down and thus becomes in the second position (i.e. the glass position; See FIGS. 1C and 1D), the first end (1), the first body (5) comprising an elongated section, and the second body (10) would look and/or function as a base/bottom, a stem, and a body of a glass, respectively. Further, in this second/glass position, the second end (20) would serve as a top of a glass. When the lid (25) is removed from the container in the glass position, the opening of a glass, which is a first opening (26), would be exposed so that a consumer can consume liquid from the container. As shown, the lid (25) may optionally include a dimple, often referred to as a punt.

The liquid container according to some embodiments of the invention can be made in a variety of dimensions. For example, the height of the container, which is marked as (a) in FIG. 1, can be about 3 to 10 inches (about 7.5 to about 25 cm). Thus, in some embodiments, the container can be about 3, 3.5, 4, 4.5, 5, 5.5, 6, 6.5, 7, 7.5, 8, 8.5, 9, 9.5, and 10 inches (about 7.5, 8.75, 10, 11.25, 12.5, 13.75, 15, 16.25, 17.5, 18.75, 20, 21.25, 22.5, 23.75 and 25 cm) in height or in any range of height within these values. Thus, for example, in some embodiments, the container can be about 5 to about 9-inches (about 12.5 to about 22.5 cm) high from the first end (1) to the second end (20).

The length of the first body (marked as (b)) and of the second body (marked as (c)) can also be various. In FIG. 1, b' and c' represents a half of b and c, respectively. For example, the first body (5) would be shorter than the second body (10), whereas the length (b) of the first body (5) can be similar or longer than that of the second body (c, 10).

As to the first and second ends (1 and 20), they may be in generally similar shapes (e.g. both of which are generally in a circular or oval shape as in FIG. 1) or be in different shapes (e.g. the first end (1) is in a rectangular shape while the second end (2) is in an oval shape or vice versa).

The area (or size) of both ends can also be various. In one example, the area (size) of the first end (1) may be larger than that of the second end (20). In another example, the second end (2) may have a larger size as compared to the first end (1). In still another example, the first and second ends (1 and 20) may have a same or similar area (size) to each other. In some particular examples wherein the first and second ends (1 and 20) are in generally a circular or oval shape, the diameter (e) of the first end (1) can be smaller, similar or larger than that of the second end (d, 20). Thus, it should be considered that an area (size) and a shape of the first and second ends (1 and 20) can be made in a variety of options and all of such variations are obviously included in the scope of the invention.

According to some aspects of the present invention, the first body (5) may be shaped as a cylinder or rod as shown in FIG. 1. In some embodiments, the first body (5) comprises an elongated section. In some of certain embodiments, the elongated section may be hollow. The diameter of the first body (5), which is marked as (g) in FIG. 1, may indicate the longest distance between one end to another of the first body when measured in a direction of x-axis. This diameter (g) of the first body can be any distance between about 0.1 to about 3 inches (about 0.25 to about 7.5 cm). The diameter (g) can be, for example, about 0.1, 0.5, 0.7, 1, 1.2, 1.5, 1.7, 2.0, 2.2, 2.5, 2.7, or 3.0 inches (about 0.25, 1.25, 1.75, 2.5, 3.0, 3.75, 4.25, 5.0, 5.5, 6.25, 6.75 or 7.5 cm). In some other examples, the diameter (g) can be more than 3 inches (7.5 cm).

As to the second body (10), it may be shaped in a cylinder, more particularly a curved dome shape in at least some embodiments. As shown in FIG. 1, the second body (10) may have a curved wall and its diameter may be varied throughout its height. The diameter of the second body (10), which is marked as (f) in FIG. 1, may indicate the longest distance between one end to another of the second body when measured in a direction of x-axis. This diameter (f) of the second body can be any distance between about 1 to 10 inches (about 2.5 to about 25 cm). In some examples, the diameter (f) can be between about 1 to 8 inches (about 2.5 to 20 cm). In some other examples, the diameter (f) can be between about 1 to 6 inches. In still some other examples, the diameter (f) can be between about 1 to 5 inches. In still some other examples, the diameter (f) can be about 1, 1.5, 2, 2.5, 3, 3.5, 4, 4.5, 5, 5.5, 6, 6.5, 7, 7.5, 8, 8.5, 9, 9.5, or 10 inches (about 2.5, 3.75, 5, 6.25, 7.5, 8.75, 10, 11.25, 12.5, 13.75, 15, 16.25, 17.5, 18.75, 20, 21.25, 22.5, 23.75 or 25 cm). Further, if desired, the diameter (f) can be larger than 10 inches (25 cm).

Figure 6D:
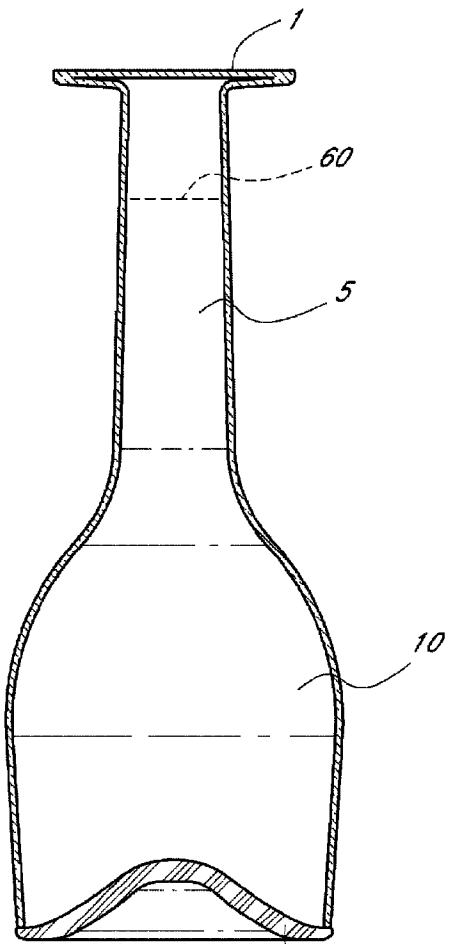
FIGS. 6A-6D shows exploded views of a liquid container according to still some other embodiments of the invention.
Figure 6C:
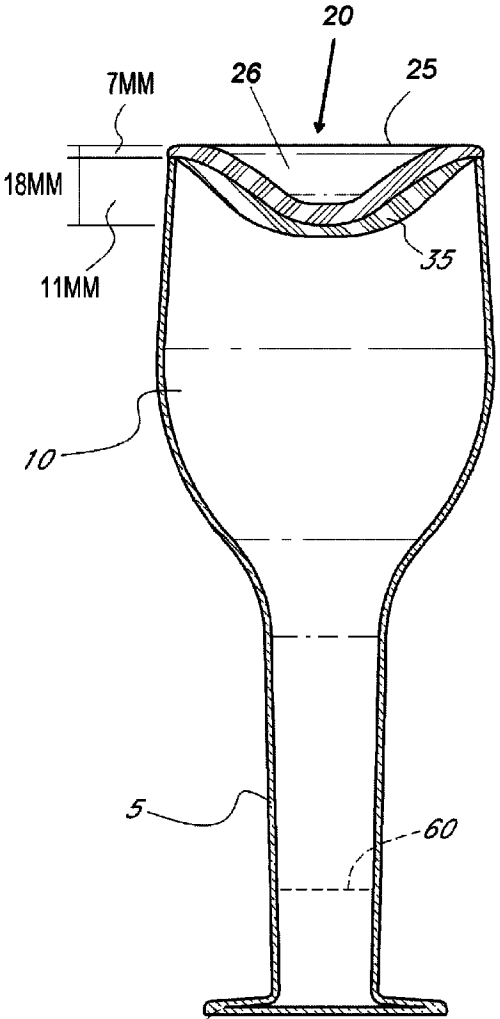
Figure 6A:
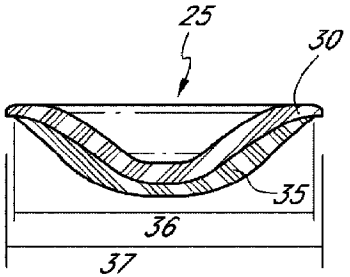
Figure 6B:
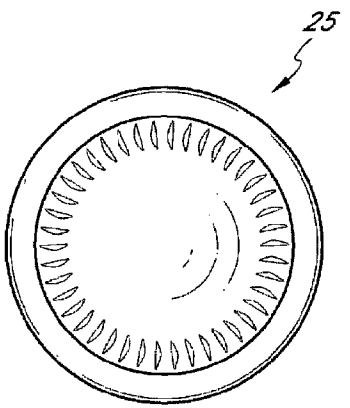
Figure 7B:
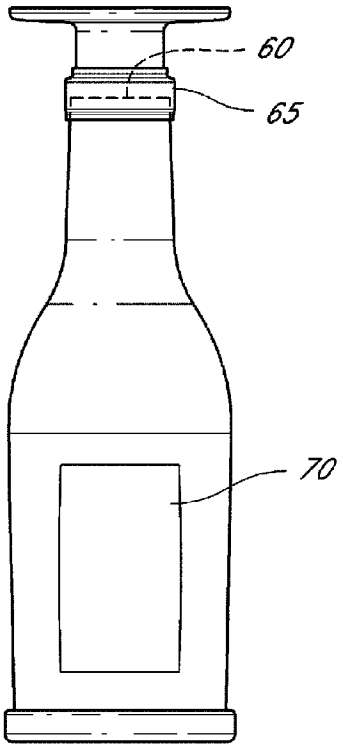
FIGS. 7A-7H shows some non-limiting illustrative examples of a liquid container according to some embodiments of the invention.
Figure 7A:
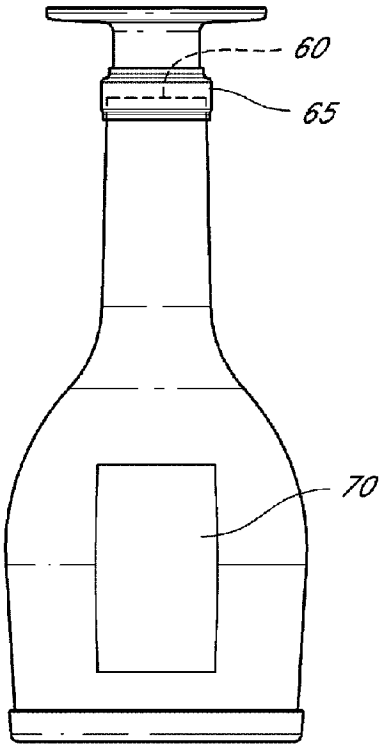
Figure 7D:
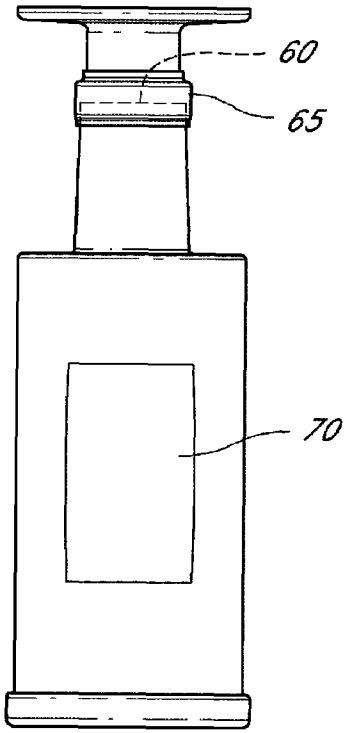
Figure 7C:
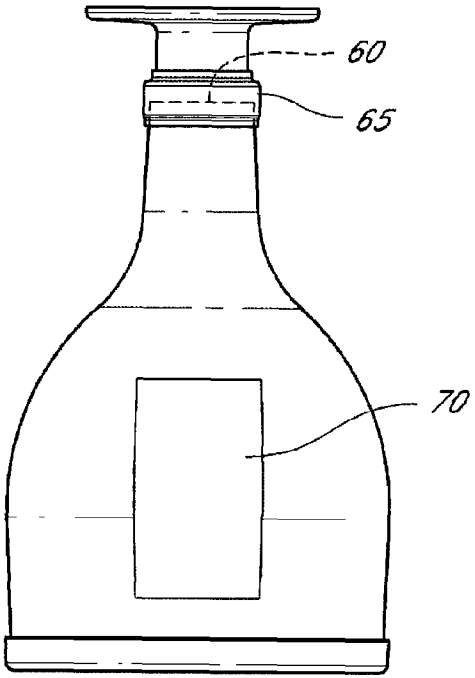
Figure 7F:
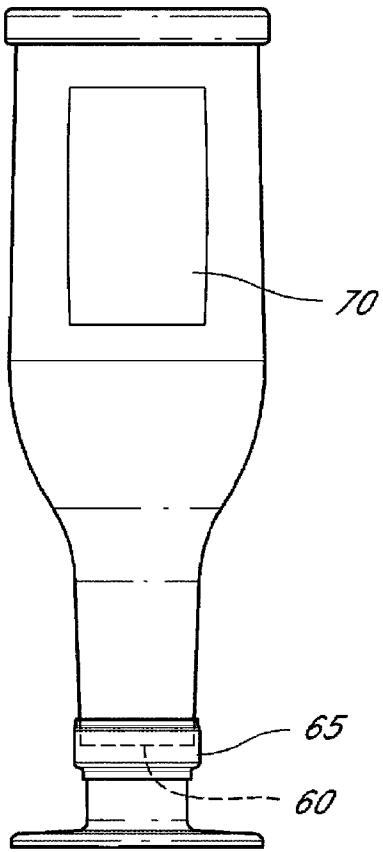
Figure 7E:
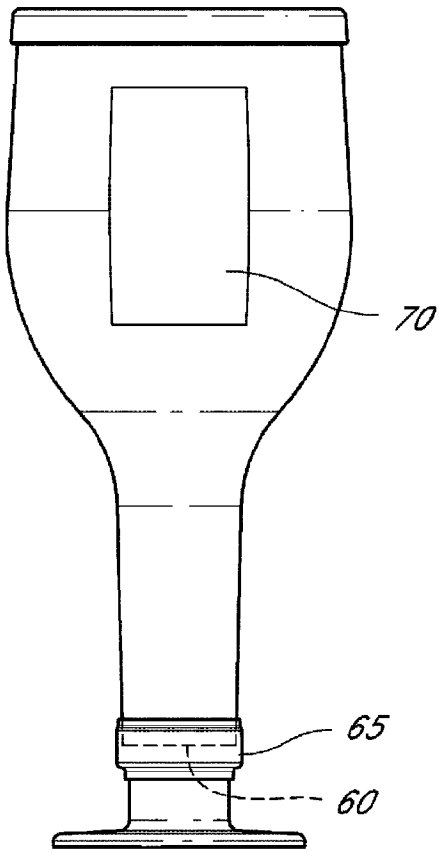
Figure 7H:
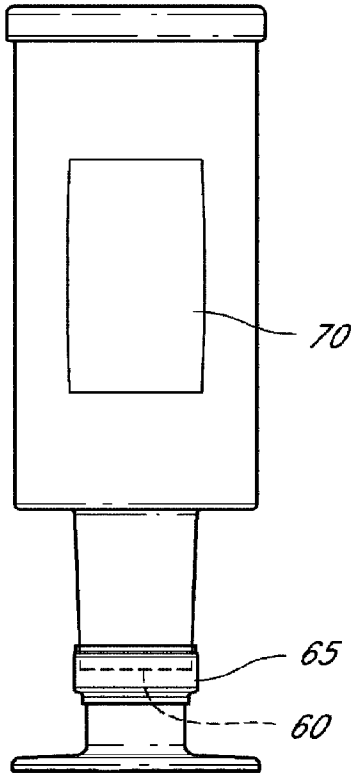
Figure 7G:
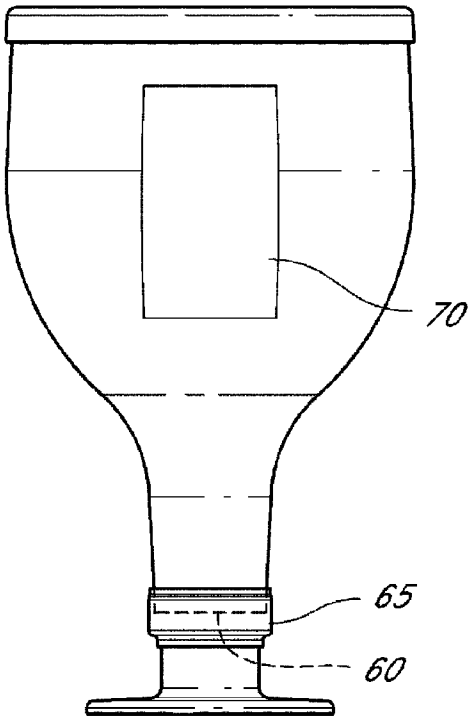

The second body (10) may have a variety of shapes. For example, the second body (10) shown in the container of FIG. 1 becomes narrower as being close to the first body (5). However, the container according to the present invention is not limited to such a shape and can be made in a variety shapes. An alternative example is shown in FIGS. 6D and 6H, wherein the second body is shaped in a generally rectangular shape and the diameter (f) of the second body is kept relatively same throughout its height.

As described above, it should be considered that an area (size) and a shape of the first and second bodies (5 and 10) as well as the first and second ends (1 and 20) can be made in a variety of options and all of such variations are obviously included in the scope of the invention.

According to various aspects of the present invention, the liquid container may be present or stand alone in at least two separate positions without any further support. In the first position (i.e. the bottle position) as seen in FIGS. 1A and 1B, the container looks and functions as a bottle (or the like).

When the container is in the bottle position, the container can hold its position without any further support. To maintain this position relatively stable, the center of gravity of the liquid container may be present somewhere within the area marked as CG1. The CG1 area generally covers the lower half of the first body (5), the entire second body (10), and the second end (20). Thus, the center of gravity of the liquid container in its bottle position can be placed anywhere in the liquid container, especially marked in the CG1 area. It would be perceivable that the center of gravity may be varied depending on the amount of the liquid contained in the liquid container. It would be likely that the center of gravity of the liquid container in its bottle position may be moved toward the lower end of the CG1 area (i.e. toward to the second end 20) if more liquid is contained in the container. If some of the liquid is removed from the container and the container becomes in its bottle position, the center of gravity may be moved toward the upper end of the CG1 area (i.e. toward the first end 1) as compared to that of the container with full amount of the liquid. In any event, however, the center of gravity of the liquid container, which is in its bottle position, would be present anywhere in the CG1 area and thus the bottle position may be kept relatively stable.

When the liquid container is in its second position (i.e. the glass position) as in FIGS. 1C and 1D, the liquid container may also be able to be present or stand alone without any support and maintain its glass position. Thus, it may look and function as a glass (or the like). To maintain this glass position relatively stable, the center of gravity of the liquid container may be present somewhere within the area marked as CG2. The CG2 area generally covers the lower half of the second body (10), the entire first body (5), and the first end (1). Thus, the center of gravity of the liquid container in its glass position can be placed anywhere in the liquid container, especially marked in the CG2 area. It would be perceivable that the center of gravity may be varied depending on the amount of the liquid contained in the liquid container. It would be likely that the center of gravity of the liquid container in its glass position may be moved toward the upper end of the CG2 area (i.e. toward to the second end 20) if more liquid is contained in the container. If some of the liquid is removed from the container and stays in its glass position, the center of gravity may be moved toward the lower end of the CG2 area (i.e. toward the first end 1) as compared to that of the container with full amount of the liquid. In any event, however, the center of gravity of the liquid container, which is in its glass position, would be present anywhere in the CG2 area and thus the glass position may be kept relatively stable.

As described above, the center of gravity of the liquid container would need to be varied depending on the position of the container. Therefore, the container in either position would stably maintain its position without any additional support. There are a variety of ways to make the center of gravity of the liquid container in the desired area (i.e. the CG1 area in the bottle positions or the CG2 area in the glass position). Especially, it would be important to ensure that the center of gravity is generally present in the CG2 area when the container is in the glass position. In some examples, most of the liquid would be contained in the relatively upper portion of the container in the glass position, and thus, such container would be easier to be tipped over as compared to the container in the bottle position. Such instability of the container would of course not be preferred by a consumer. Accordingly, the stability of the liquid container to maintain its glass position would be sufficient so that a consumer would use this container like a conventional wine glass, goblet, or cup.

One way to ensure that the center of the gravity is present in the CG2 area when the liquid container is in the glass position is to provide more weight in the lower portion of the container (i.e. the lower half of the second body 10, the first body 5 and/or the first end 1) than in the upper portion of the container (i.e. the upper half of the second body 10 and the lid 25). Therefore, even the container in its glass position contains a full amount of liquid, the center of gravity of the container is generally kept within the CG2 area.

In one example, the material(s) used in this lower portion of the container (i.e. the lower half of the second body 10, the first body 5 and/or the first end 1) would be generally heavier than those used in the upper portion of the container (i.e. the upper half of the second body 10 and the lid 25). More particularly, the first body (5) and/or the first end (1) may be made of heavier material(s) than those used in the second body (10) and/or the lid (25). Therefore, in one particular example, the lower portion of the container may be made of a heavy glass whereas the upper portion of the container may be made of a lighter material such as an acrylic. In addition, the lid (25) may be made of a relatively light material such as an acrylic as compared to those used in the rest of the container and thus it would not significantly add weight to the upper portion of the container.

In addition, to add more weight in the lower portion of the container in the glass position (i.e. the lower half of the second body 10, the first body 5 and/or the first end 1), the size of the lower portion may be varied as well. If desired, the first body (5) and/or the first end (1) may be made in a larger size. In other words, the diameter (g) and/or the length (b) of the first body (5) can be increased, and the thickness as well as the diameter (e) of the first end (1) can also be increased.

Alternatively, the thickness of each portion of the container may be made differently. The wall of the second body (10) would be thicker as it is close to the first body (5) and therefore more materials (e.g. glass) would be present in the lower half of the second body (10).

In another example, more weight can be provided in the lower portion of the container in the glass position (i.e. the lower half of the second body 10, the first body 5 and/or the first end 1) by adding some heavy materials to the lower portion. For instance, metals and any other heavy materials may be added, for example, in a form of label or accessories in the first body (5) and/or the first end (1). Alternatively, one or more additional sub-structure can be attached, added, and/or placed in the first body (1) and/or the first end (1). Therefore, in one particular example, a type of stopper such as a cork can be placed in the first body (5) and/or the first end (1). Such stopper can be made of any materials such as wood including cork, glass, metals, any synthetic or natural polymers, and any combinations thereof. In addition, the stopper in the first body (5) and/or the first end (1) may provide a look of a conventional wine bottle with a cork to the liquid container when it is in its bottle position.

In still another example, the first body (5) may be manufactured in a filled or solid form that is made of a glass or any other suitable materials. More specifically, a dense or heavy material such as heavy glass may be used to make the first body (5) whereas the upper portion (e.g. the lid 25) may be made of a lighter material such as an acrylic.

By having one or more configurations as discussed above, generally more weight would be present in the lower portion of the container (i.e. the lower half of the second body 10, the first body 5 and/or the first end 1) when the container is in its glass position and thereby the center of gravity would be kept within the CG2 area. While various aspects and embodiments have been disclosed in the above, especially regarding how to maintain the center of gravity within the CG2 area when the container is in the glass position, other aspects and embodiments will be apparent to those skilled in the art. The various aspects and embodiments disclosed herein are for purposes of illustration and are not intended to be limiting, with the true scope and spirit of the present invention.

Figure 1E:
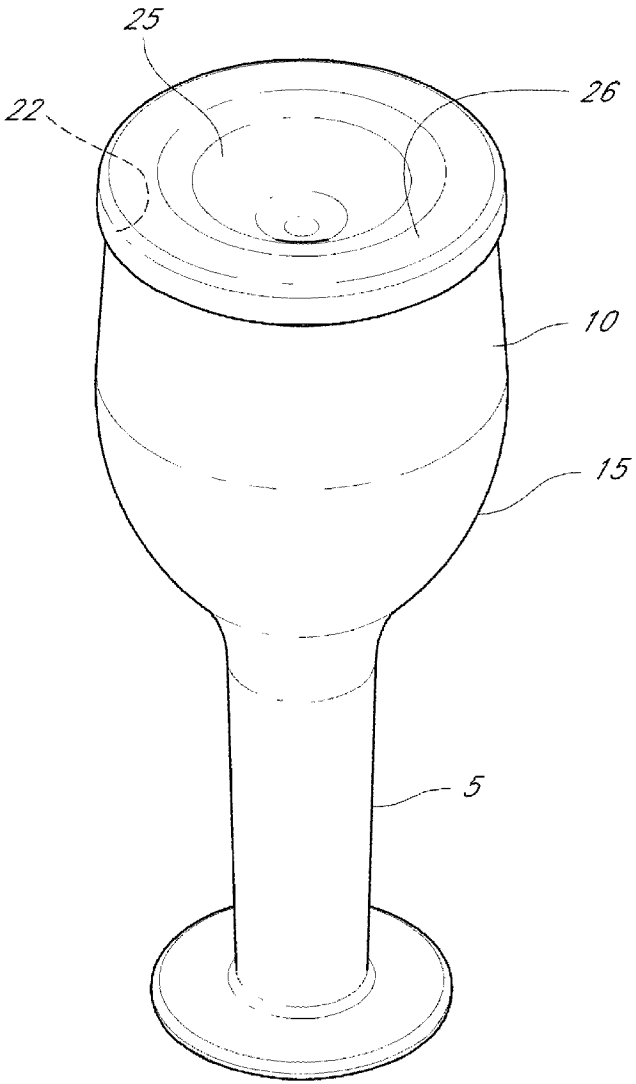

One aspect of the invention is related to a lid. The lid is generally used to close the opening of the liquid container such that the liquid is contained in the container without being leaked. A non-limiting and illustrative example of the lid (25) is shown in FIGS. 1A-1D and an exploded top view is shown in FIG. 1E. The lid in this example looks and functions as a base/bottom of a bottle in FIGS. 1A and 1B. When the container is turned upside down and thus becomes in its second position (i.e. FIGS. 1C-1E), the lid (25) is presented on top of a glass. This lid (25) would be removed once the liquid contained in the liquid container is desired to be consumed.

A lid of a liquid container according to some embodiments of the present invention can be made in a variety of shapes and size. Some non-limiting examples of such lid are shown in FIGS. 2-5 for the illustration purpose.

Figure 2B:
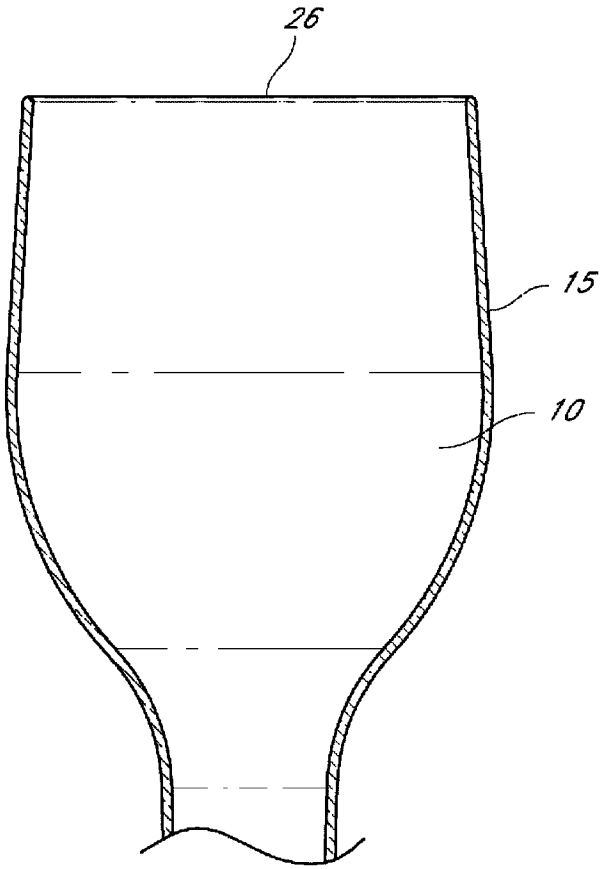
FIGS. 2A-2D shows exploded views of a portion of liquid containers according to some embodiments of the invention.
Figure 2A:
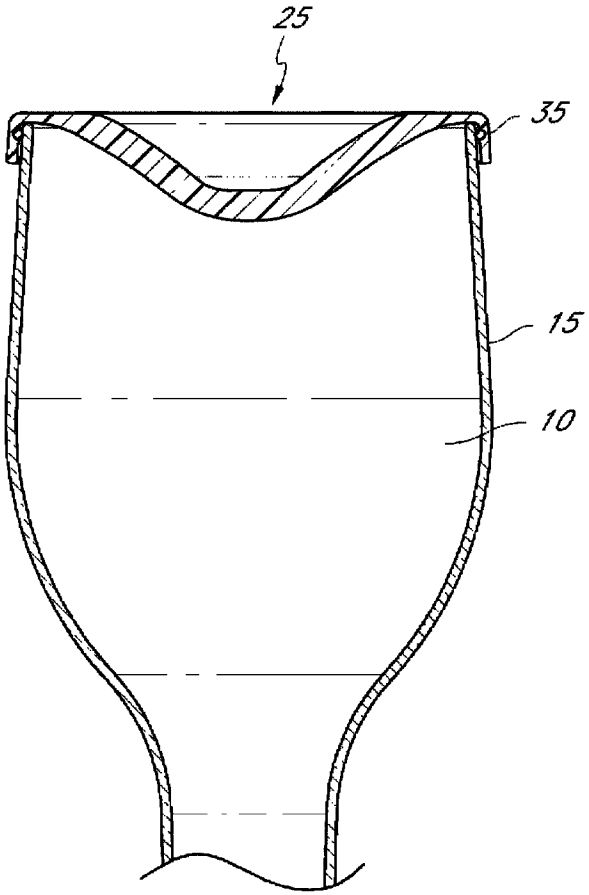
Figure 2D:
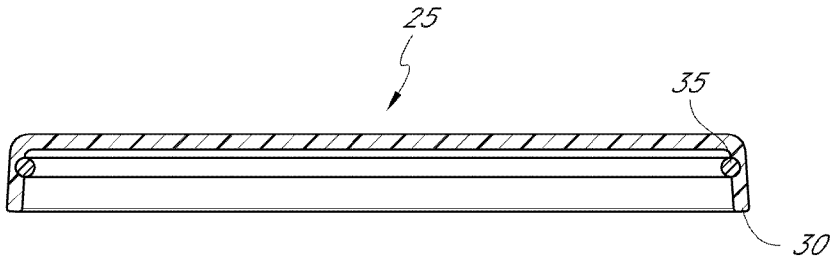
Figure 2C:
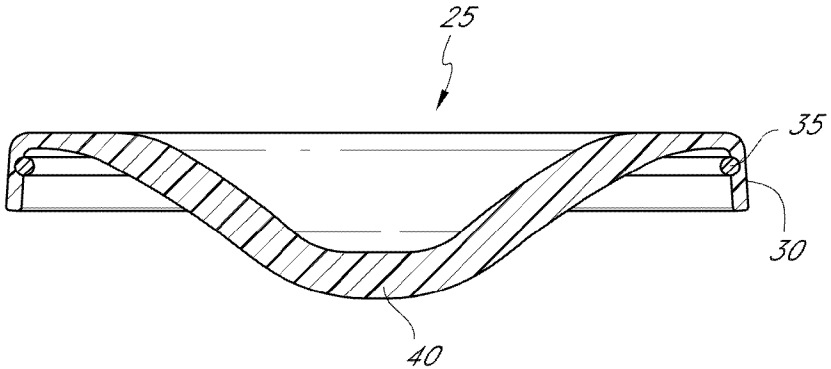
Figure 3B:
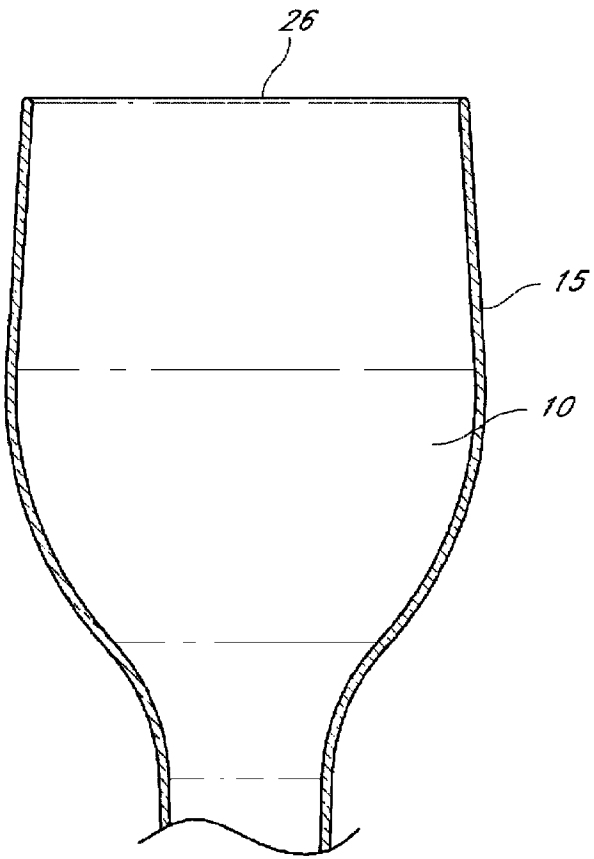
FIGS. 3A-3D shows exploded views of a portion of liquid containers according to some other embodiments of the invention.
Figure 3A:
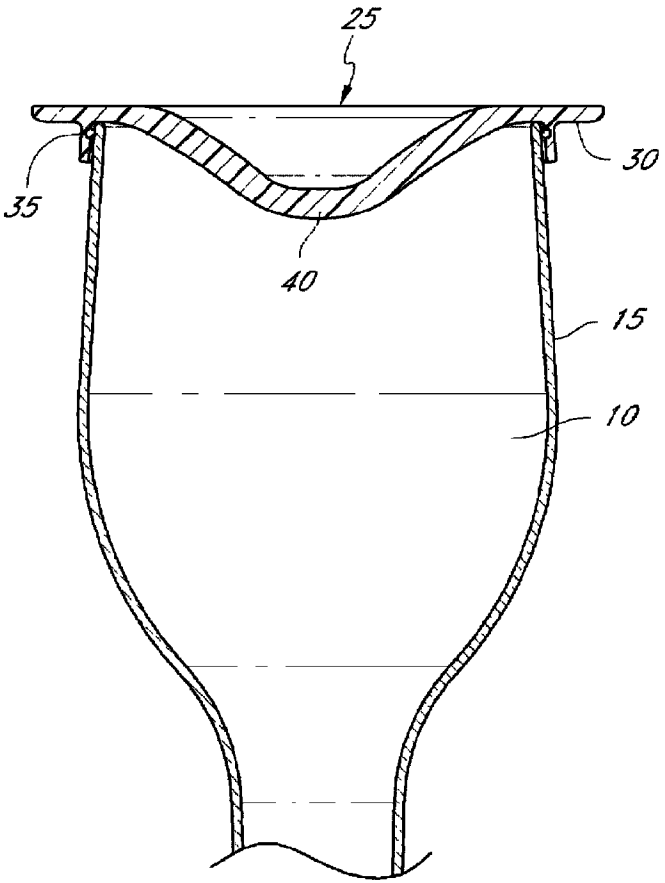
Figure 3C:
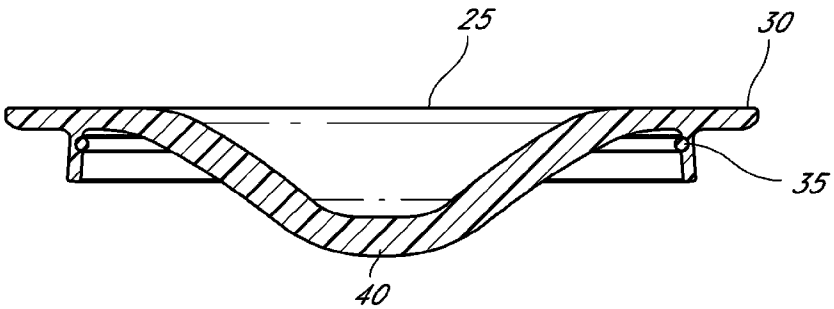
Figure 3D:
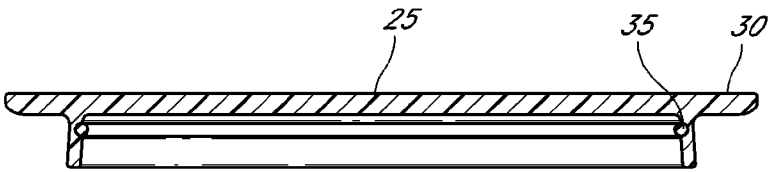
Figure 4B:
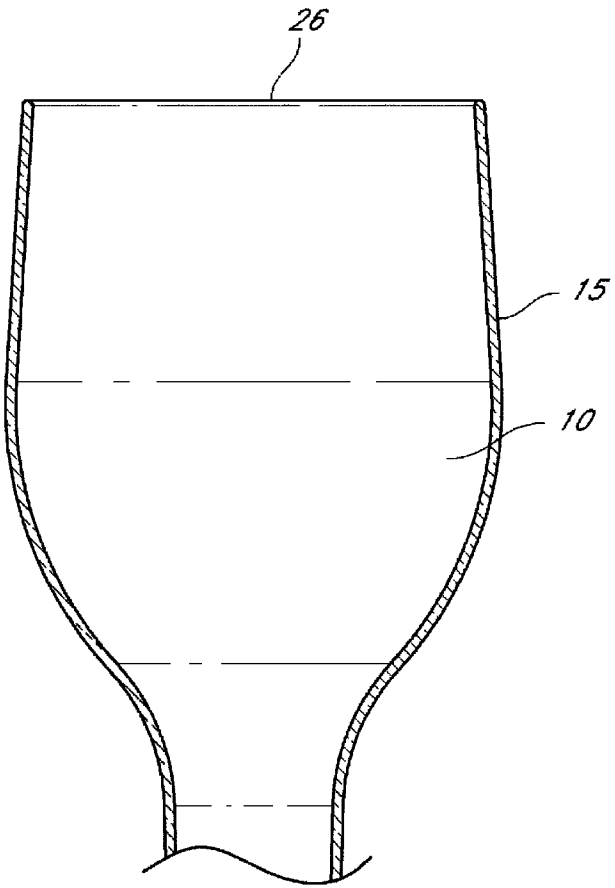
FIGS. 4A-4D shows exploded views of a portion of liquid containers according to still some other embodiments of the invention.
Figure 4A:
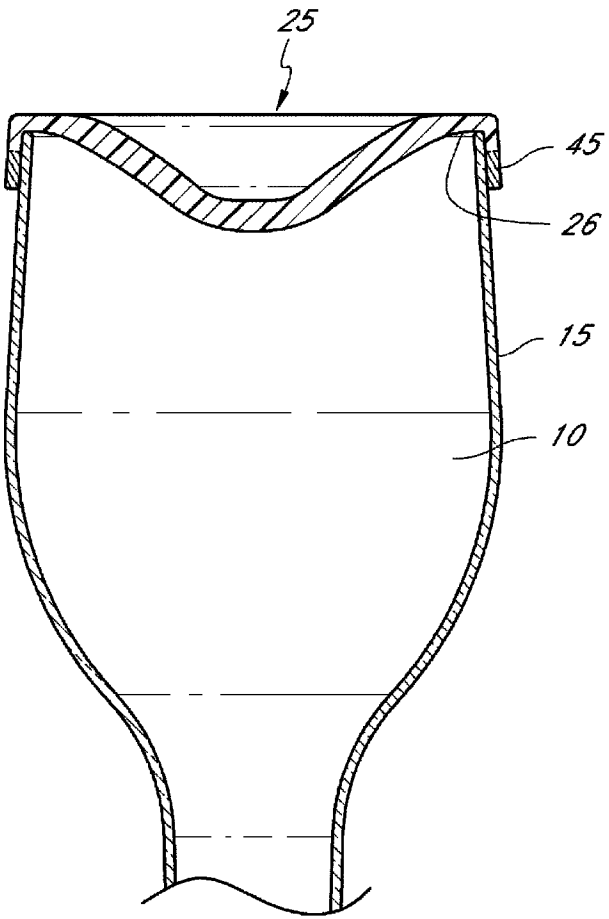
Figure 4D:
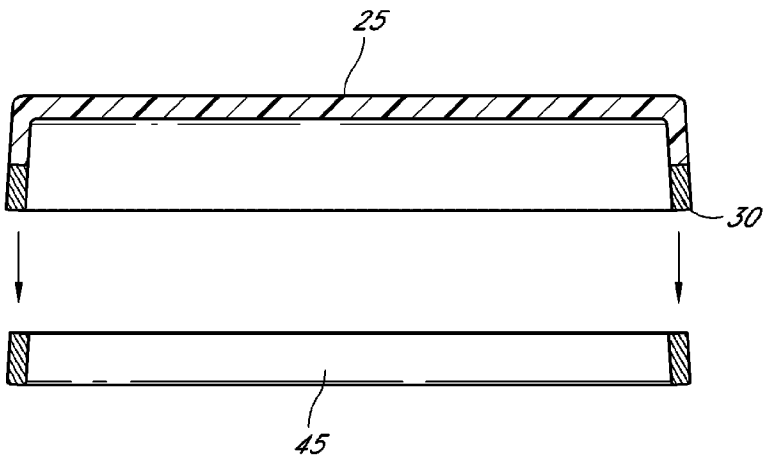
Figure 4C:
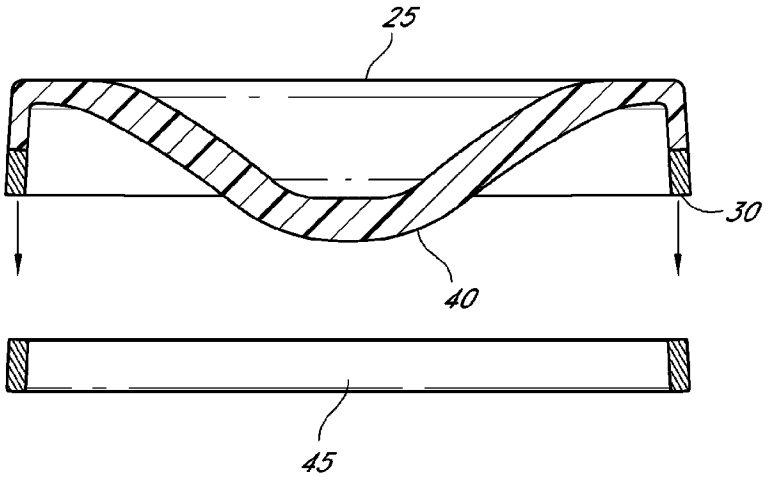
Figure 5B:
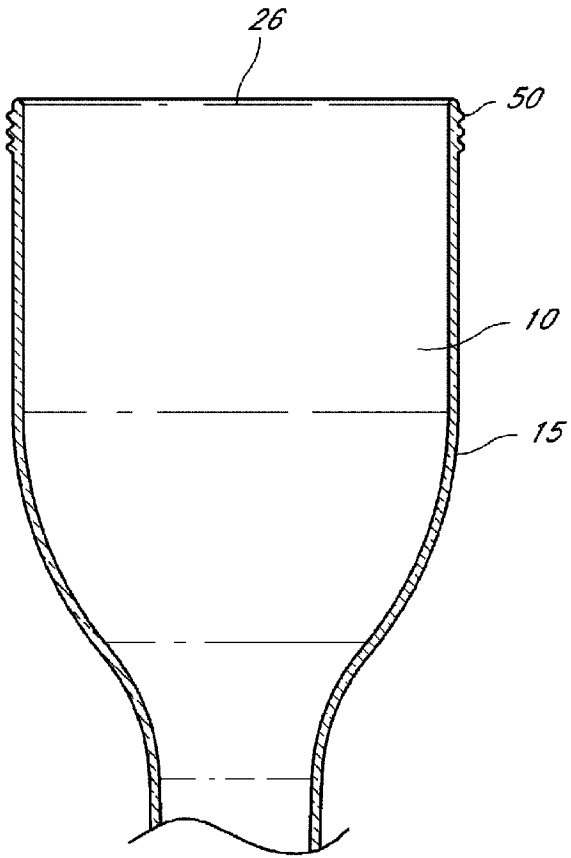
FIGS. 5A-5D shows exploded views of a portion of liquid containers according to still some other embodiments of the invention.
Figure 5A:
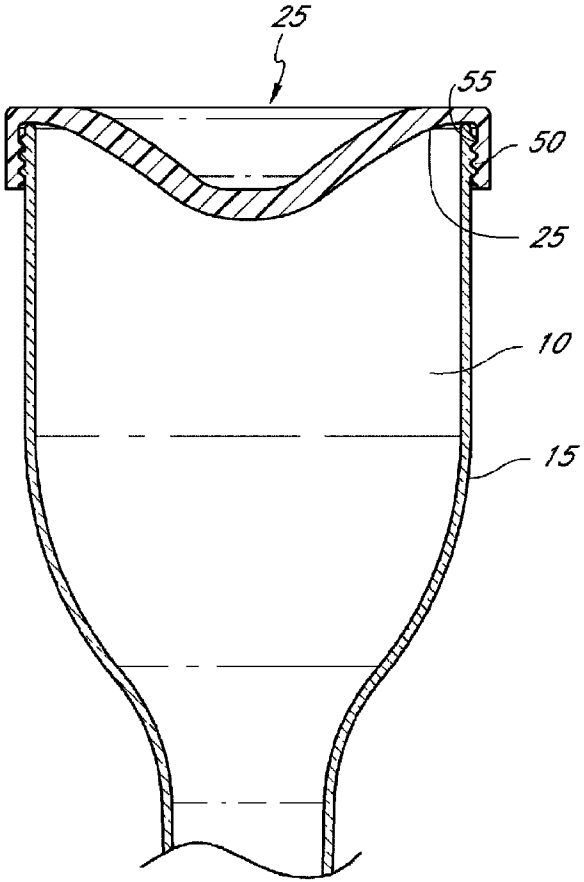
Figure 5C:
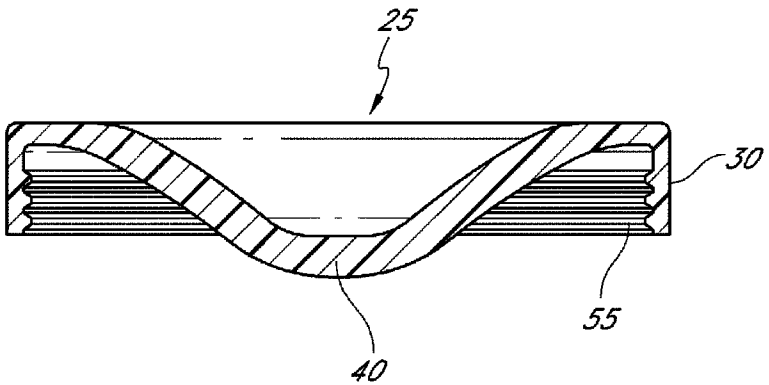
Figure 5D:
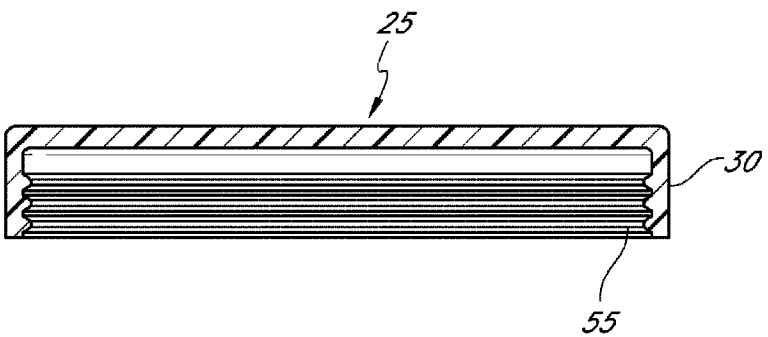

In FIG. 2, especially, in FIGS. 2A and 2C, the lid (25) may comprise a wall (30), a protrusion (40), and a secure element (35). The wall (30) and the protrusion (40) may be made as one piece or alternatively made in at least two separate pieces and associated. In any event, the wall (30) and the protrusion (40) may be made of a glass, a metal, and/or any synthetic or natural polymer such as an acrylic and a resin. Further, each of the protrusion (40) and the walls (30) can be made of more than one material. Therefore, in one example, the entire lid including the walls (30) and the protrusion (40) may be made of a glass or an acrylic. In another example, the protrusion (40) may be made of a glass whereas the walls (30) may be made of a resin. Any further obvious combination would be of course included in the scope of the present application.

The lid may comprise a secure element (35) to tightly seal the container and prevent leakage of the liquid. In one example, the secure element (35) may be a type of O-ring that would be made of a resin or any flexible (synthetic or natural) polymer. Thus, in such example, the secure element (35) would tightly contact the wall of the second body (10) and prevent the liquid contained in the container from being leaked therefrom. The examples shown in FIG. 2 generally illustrate the secure element (35) contacting the outside wall (15) of the second body (10); however it is not limited to such a configuration only. Therefore, the walls (30) of the lid (25) may be configured to be placed inside the second body (10) and the secure element (35) may be placed between the inner wall (22) of the second body (10) and the outside wall of the walls (30). Optionally, the inner or outer wall of the second body (10) may comprise one or more groove in which the secure element(s) may fit tightly. In any event, a consumer or any one who would desire to open the lid can easily remove the lid from the liquid container by twisting and/or pulling out the lid from the container. After such removal, the liquid container looks and functions as a glass or goblet as shown in FIG. 2B. In some variations, the protrusion (40) may not be present and thus the lid such as in FIG. 2D can be used. FIG. 3 shows some alterations of the lid wherein the wall (30) is in a flat or plane form. If desired, the lid in any of the foregoing examples can be used again to re-seal the container.

Some further alternations in the lid structure are shown in FIG. 4. In this example, the lid may be formed similar to those illustrated in FIG. 2 but utilize a different closure mechanism. The lid may cover the opening (20) relatively tightly as seen in, for example, FIG. 4A, and a secure band (45) can be wrapped around the lid (25) to tightly seal the container. In such example, a consumer or any one who would desire to remove the lid may need to unwrap the secure band (45) from the container and easily take the lid off. This particular mechanism may be used in combination with the previous embodiment, which is using an O-ring type of secure element (35) to further tighten the closure. The secure band (45) can be made of any material suitable to prevent the liquid leakage. In addition, the secure band (45) may further comprise an adhesive to enhance the security of the closure.

Still some further alterations in the lid structure are shown in FIG. 5. The particular example shown in this figure utilizes a screw-type of closure. Thus, as illustrated in FIG. 5A, the side wall of the lid (25) as well as the second body (10) comprise notches (50 and 55). The detailed views of this screw-type of lids are further illustrated in FIGS. 5B and 5C. After removal of the lid, the second body may comprise the notches on its inner or outer wall as seen in FIG. 5B. If desired, the lid can be used again to re-seal the container.

FIG. 6 shows still another embodiment of the lid structure according to the invention. The lid in this particular embodiment may comprise a wall (30) and a secure element (35) (FIG. 6A). The lid may be formed to have a generally flat base and a protruding portion in the center of the base. The secure element (35) may tightly contact the wall of the second body (10) and prevent the liquid contained in the container from being leaked therefrom. Also, in this embodiment, the inner and outer diameters of the lid (36 and 37) are substantially same to those of the opening (26). Therefore, after closure, there may seem no obvious disconnection between the lid and the second body when viewed laterally. Rather, the lid may seem as an integral part of the second body, not as a separate element. In addition, a surface of the lid that faces an exterior of the container may have embossed details as illustrated in FIG. 6B. FIG. 6C provides dimensions of the lid part according to some embodiments. These dimensions can be further varied without any restrictions along with the dimensions of the container as disclosed elsewhere in the application.

Figure 9C:
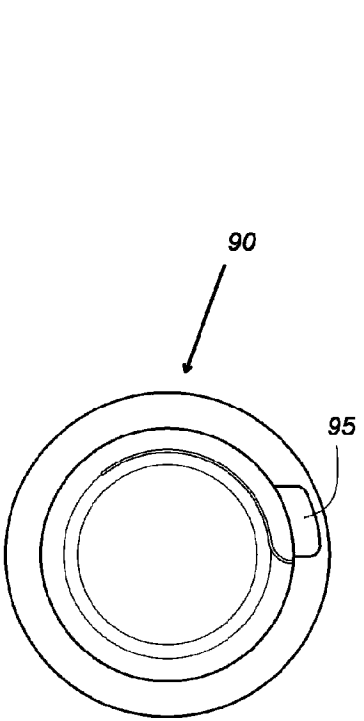
FIGS. 9A-9C show still an alternative embodiment of a container according to the invention.

In certain embodiments, the container may comprise a first opening (26) and a second opening (60). The first opening may be closed by the lid (25). The second opening (60) may be secured by a secure element (65) as illustrated in FIG. 7 below. Alternatively, there may be an additional lid (80), an example of which is illustrated in FIG. 9. In some embodiments, the lid (25) may be secured to the first opening (26) prior to the closure of the second opening (60). In such embodiments, the liquid may be provided to the container via the second opening (60) after the first opening (26) is closed. Alternatively, the second opening (60) may be closed before the first opening (26) is closed. In such embodiments, the liquid may be provided via the first opening (26) after the second opening (60) is pre-sealed.

In addition to the foregoing, FIG. 7 presents further non-limiting and illustrative embodiments of a liquid container according to some embodiments of the present invention. The liquid container in some of embodiments may comprise one opening as shown in FIGS. 1-6; however, the container may comprise additional opening(s) in some other embodiments. Therefore, as shown in, for example, FIGS. 7A-7D, the first body (5) may comprise a second opening (60), which may be covered by a secure element (65). In such embodiments, the liquid may be provided into the container via a first opening (20) or via a second opening (60) during the manufacturing process. The second opening may be reversibly or irreversible secured after provision of the liquid. If desired, the second opening (60) may be opened to transfer the liquid to a separate container.

FIG. 7 also show a variety of shapes of a liquid container that can be used in at least two separate positions. In FIGS. 7A-7D, the containers are in their first positions, which are the bottle position. However, by being turned upside down, these containers are in their second positions, i.e. the glass position in FIGS. 7E-7H. As described elsewhere in the present application, the size and shape of the container can be varied. For instance, the second body may be in a generally cylinder shape with a curved wall as in FIGS. 7A-7C and FIGS. 7E-7G. Alternatively, the liquid container may comprise square-shaped walls as seen in FIGS. 7D and 7H.

In addition, the width as well as the size of the container can be highly variable. Accordingly, the amount of liquid contained in the liquid container may vary from about 20 ml to 500 ml of liquid, or about 75 to about 300 ml of liquid. In some examples, the liquid container may be able to contain about 20 ml, 30 ml, 60 ml, 80 ml, 100 ml, 150 ml, 200 ml, 250 ml, 300 ml, 350 ml, 400 ml, 450 ml, or 500 ml of liquid. In some other examples, the liquid container may be able to contain about 100 ml, 110 ml, 120 ml, 130 ml, 140 ml, 150 ml, 160 ml, 170 ml, 180 ml, 190 ml, and 200 ml of liquid. In still some other examples, the liquid container may be able to contain about 160 ml, 165 ml, 170 ml, 175 ml, 180 ml, 185 ml, 190 ml, 195 ml, and 200 ml of liquid. In still some other examples, the liquid container may be able to contain about 180 ml, 181 ml, 182 ml, 183 ml, 184 ml, 185 ml, 186 ml, 187 ml, 188 ml, 189 ml, and 190 ml of liquid. In still some other examples, the liquid container may be able to contain about 187 ml of liquid. In still some other examples, the liquid container may contain more than about 500 ml of the liquid.

The liquid may be present in the first and/or second bodies of the liquid container. The first body (5) can be hollow and thus contain the liquid. Alternatively, at least part of the first body (5) may be a closed and filled structure and thus the liquid may not be contained in such part. As to the second body (10), the relatively entire area of the second body may be hollow and thus contain the liquid; however in some examples, at least part of the second body may be filled with, for example, a glass or acrylic, and thus such filled part may not be able to contain the liquid.

Figure 8B:
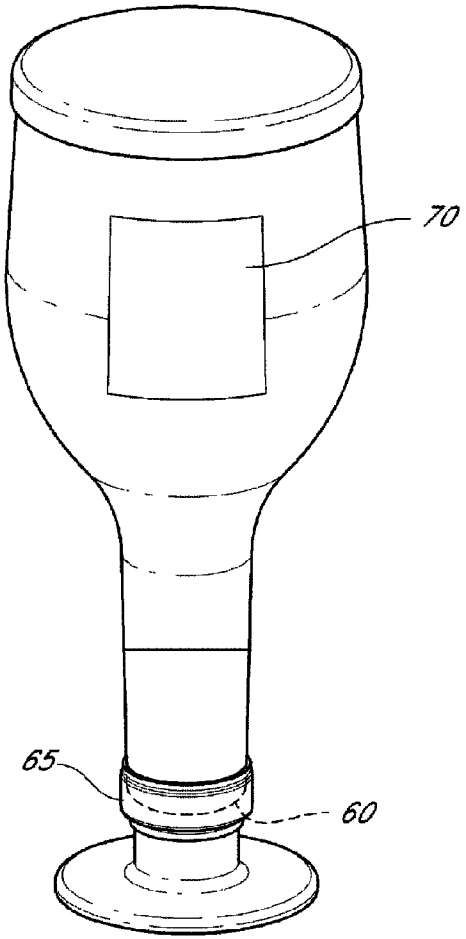
FIGS. 8A and 8B show a three-dimensional illustration of a liquid container according to some embodiments of the invention.
Figure 8A:
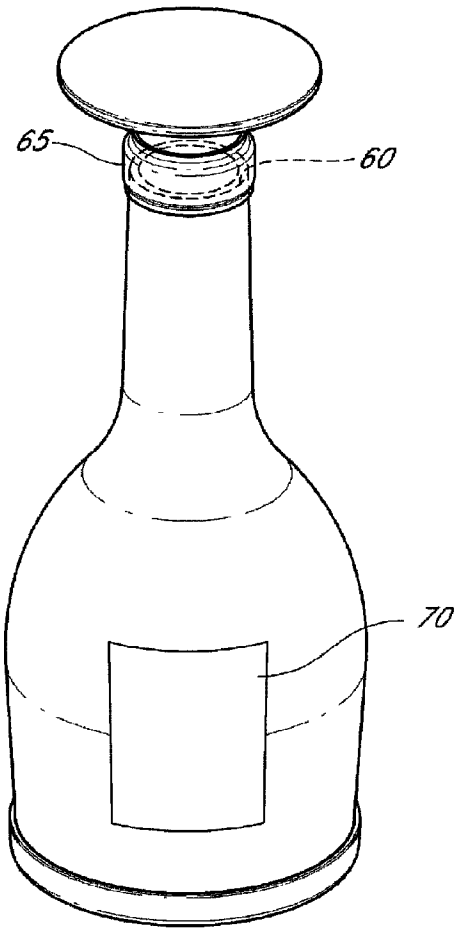

The liquid container according to some embodiments of the present invention may further comprise additional elements such as a label (70). A label in this application generally includes any additional elements that may be attached inside or outside of the liquid container. Some illustrative examples of such labels are shown in FIGS. 7 and 8. The labels may be added to provide information about the liquid (e.g. the name of wine, production date and place, nutrition information, storage information, and others). The label may be attached to the container in a way that is readable when the container is in one of two positions (i.e. bottle or glass position). Alternatively, a plurality of the labels may be attached to be read and/or used in both of the two positions.

Figure 9B:
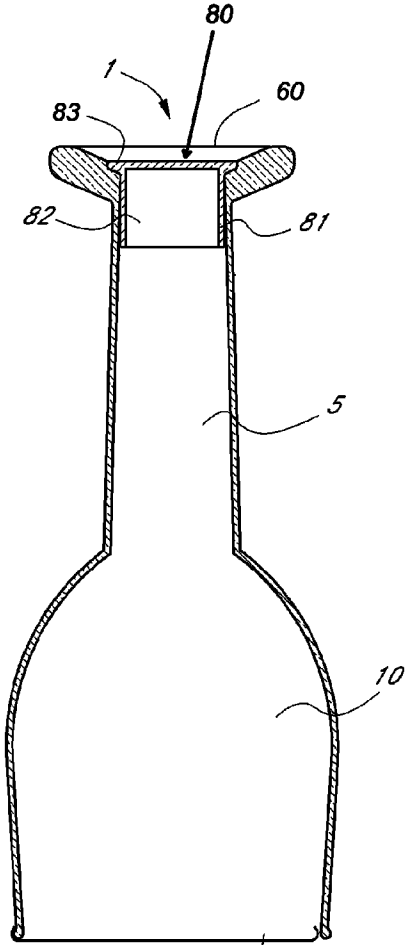
Figure 9A:
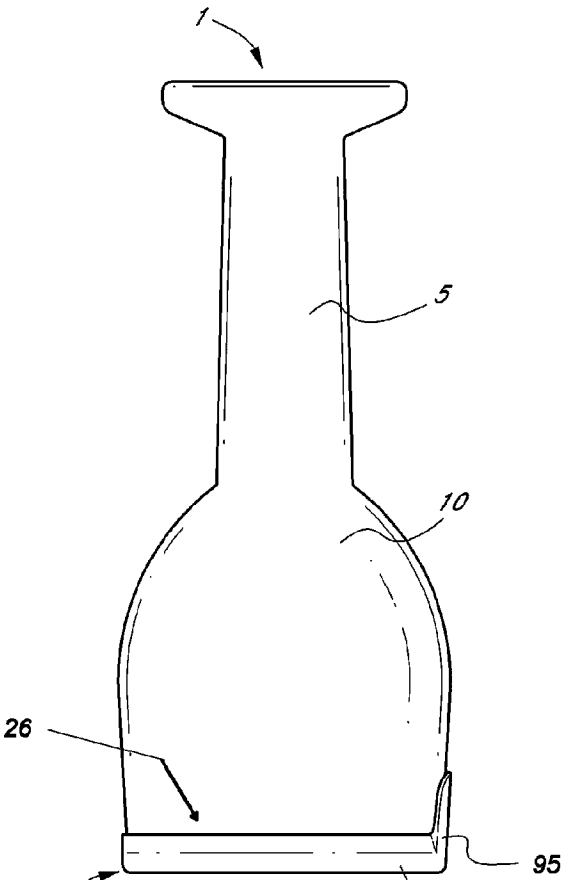

FIG. 9 shows still another embodiment of a container according to the invention. In this particular embodiment, the container comprises two openings (26 and 60) and each opening is closed by a separate closure system. The first opening (60) is placed at the first end (1), and the second opening (26) is placed at the second end (20). In some embodiments, there may be a first lid or closure system for the first opening (60) that is configured to fit in the first opening (60) and at least part of the hollow section of the first body (5). This first lid or closure system (80) for the first opening (60) may tightly contact the first opening and the first body to prevent the liquid contained in the container from being leaked therefrom. The first lid or closure system (80) may provide an airtight closure. The first lid or closure system (80) may be made of any suitable materials, such as a glass, a metal, and/or any synthetic or natural polymer. In certain embodiments, the first lid or closure system (80) may be made of cork, which is a typical material for closure of wine bottles. The first lid or closure system (80) may comprise a wall (81), an interior area (82), and a base (83). The interior of the first lid or closure system may be substantially or partially hollow. The first lid or closure system (80) may fit in the first opening (60) and the first body (5) so that showing of the first lid or closure system (80) outside of the container may be minimized. For this, the diameter of the base (83) of the first lid or closure system (80) may be smaller or substantially same to that of the first end (1) or the first opening (60). Also the shape and diameter of the wall portion (81) of the first lid or closure system (80) may be formed to tightly fit in the side wall of the first body (5) as illustrated in FIG. 9*b*. In alternative embodiments, a further closing element(s) may be applied to the container if desired.

As for the second opening (26), there may be a second lid or closure system to close the second opening as disclosed elsewhere in the application (e.g. FIGS. 1-7). In alternative embodiments illustrated in FIG. 9, the second opening (26) may be secured by a two-element system. This two-element system comprises a first closing element (85) and a second closing element (90). In some embodiments, the first closing element (85) may be a form of an airtight seal, which is made of foil. Securing the first closing element (85) to the second opening (26) can be done by various methods including gluing. In certain embodiments, a suitable type of glue may be applied around the rim of the second end (20), and contact the first closing element (85) to secure the same. In certain embodiments, there may be an additional closing element (90) over this first closing element (85). The additional second closing element (90) may comprise a pull tab (95) (FIG. 9A) or tear tap (FIG. 9C) which will be used to remove the second closing element (90) during serving. Any suitable material can be used to produce the second closing element (90), and especially any plastic material or synthetic polymer can be used. These two closing elements may be removed during serving the liquid.

In some embodiments, sealing the first and second closing elements (85 and 90) on top of the second opening (26) may occur simultaneously. For example, the first closing element (85) may be placed on top of the second opening (26). A suitable type of glue is applied around the rim of the second end (20) or on the area of the first closing element (85) that contacts with the rim of the second end (20). Then, the second closing element (90) may be applied on top of the first closing element (85). Once two closing elements are in position, heat and/or pressure may be applied to the container so that the glue may be melt and associate with the first closing element while the second closing element is also secured to the container.

When filling a liquid to a container, it can be provided via a first or second opening. If the first opening is used to provide the liquid, the second opening may be sealed beforehand. For example, if the liquid is provided via the first opening (60), the second opening (26) may be pre-sealed with the second lid or closure system prior to the provision of liquid. The liquid may be provided to the first opening (60) which will then be closed by the first lid or closure system. Alternatively, the first opening (60) may be sealed first, and the liquid may be provided via the second opening (26). Sealing of each opening may be permanent or reversible. In particular embodiments, once the liquid is filled in the container, the first opening (60) may be permanently sealed while the second opening (26) may be detachably sealed and later re-opened during serving.

In some embodiments, a container according to the invention may be manufactured by the following processes: providing a compartment comprising the first end, the second end, the first body, and the second body; detachably sealing the second end with a closure; providing liquid inside the container; and permanently sealing the first end with an additional closure.

As for a method of serving, in certain embodiments, it can be done as follows: providing the liquid in a container, which is in the shape of a bottle with an elongated section at its top in a first position and a hollow body below the elongated section in the first position, wherein the container is in the first position in which the container has a first center of gravity from the midpoint of the elongated section to a bottom end of the hollow body, and wherein a detachable closure seals the bottom end of the hollow body in the first position; converting the container into a glass or goblet without reassembling any part of the container by placing the container in a second position in which the container has a second center of gravity from the midpoint of the hollow body to a bottom end of the elongated section; detaching the closure when the container is in the second position; and serving the liquid from the container in the second position without reassembling the closure to the container.

While various aspects and embodiments have been disclosed herein, other aspects and embodiments will be apparent to those skilled in the art. The various aspects and embodiments disclosed herein are for purposes of illustration and are not intended to be limiting, with the true scope and spirit of the present invention.

What is claimed is:

1. A liquid container, which is in the shape of a bottle with an elongated section at its top in a first position and is convertible to a glass or goblet in a second position with the elongated section at the bottom without reassembling any part of the container, comprising:

a first end comprising a closed end that is closed by being sealed with a first closure;

a second end comprising an open end wider than said elongated section;

a first body comprising said elongated section;

a second body comprising a hollow container; and a second closure, which is adapted to seal said open end of said second end in said first position and to be detached from said open end of said second end in said second position;

wherein in the first position the container has a first center of gravity from the first end to a midpoint of the first body when said container is empty and when said container is full of liquid; and wherein in the second position the container has a second of center of gravity from the second end to a midpoint of the second body when said container is empty and when said container is full of liquid and wherein, in the second position, the first end forms a base of the glass or goblet;

the second end forms an opening of the glass or goblet;

the first body forms a stem of the glass or goblet; and the second body forms a body of the glass or goblet.

2. The container according to claim 1, wherein said elongated section is hollow such that said first body and said second body comprise a single hollow container.

3. The container according to claim 1, wherein, in the first position, the first end forms a bottle top;

the second end and the second closure form a bottle base;

the first body forms a bottle neck; and the second body forms a bottle body.

4. The container according to claim 1, wherein the first closure fits in the first end and part of the first body, thereby forming an airtight seal.

5. The container according to claim 1, wherein the first closure is made of one or more selected from the group consisting of natural polymers, synthetic polymers, glass, and metal.

6. The container according to claim 1, wherein the first closure comprises cork.

7. The container according to claim 1, wherein the second closure is a re-sealable closure.

8. The container according to claim 1, wherein the second closure comprises a punt.

9. A method of manufacture the container according to claim 1 comprising:

providing a compartment comprising the first end, the second end, the first body, and the second body;

detachably sealing the second end with the second closure;

providing liquid inside the container; and permanently sealing the first end with the first closure.

10. The container according to claim 1, wherein the liquid is provided to the container via the first end thorough its open end.

11. The container according to claim 10, wherein the first end is permanently sealed with the first closure after provision of the liquid to the container.

12. The container according to claim 1, wherein the second closure comprises a secure element, which is configured to prevent leakage of the liquid contained in the container.

13. The container according to claim 12, wherein the secure element comprises an O-ring.

14. The container according to claim 1, wherein the second closure comprises a first closing element, and a second closing element, said first closing element being adapted to seal said open end of said second end in said first position and the second element being adapted to cover the first element.

15. The container according to claim 14, wherein the first closing element is in form of foil seal that provides an airtight seal to said open end of said second end.

16. The container according to claim 14, wherein the second closing element comprises a pull tab or tear tab.

17. The container according to claim 14, wherein the second closing element is made of a plastic material.

18. A method of serving a liquid comprising:

providing the liquid in a container, which is in the shape of a bottle with an elongated section at its top in a first position and a hollow body below the elongated section in the first position, wherein the container is in the first position in which the container has a first center of gravity from the midpoint of the elongated section to a bottom end of the hollow body, and wherein a detachable closure seals the bottom end of the hollow body in the first position;

converting the container into a glass or goblet without reassembling any part of the container by placing the container in a second position in which the container has a second center of gravity from the midpoint of the hollow body to a bottom end of the elongated section;

detaching the closure when the container is in the second position; and serving the liquid from the container in the second position without reassembling the closure to the container.

19. The method of claim 18, wherein the liquid is a wine.

* * * * *